US008776396B2

(12) United States Patent
Huynh

(10) Patent No.: US 8,776,396 B2
(45) Date of Patent: Jul. 15, 2014

(54) BEACH SANDAL

(76) Inventor: Chi Huynh, San Dimas, CA (US)

( * ) Notice: Subject to any disclaimer, the term of this patent is extended or adjusted under 35 U.S.C. 154(b) by 632 days.

(21) Appl. No.: 12/853,032

(22) Filed: Aug. 9, 2010

(65) Prior Publication Data

US 2012/0030966 A1 Feb. 9, 2012

(51) Int. Cl.
*A43B 3/12* (2006.01)
*A43B 7/08* (2006.01)

(52) U.S. Cl.
USPC ..... 36/11.5; 36/3 B

(58) Field of Classification Search
USPC ..... 36/11.5, 3 B, 8.1, 3 R
See application file for complete search history.

(56) References Cited

U.S. PATENT DOCUMENTS 616,112 A * 12/1898 Kennedy ..... 36/3 R
D166,123 S 3/1952 Pastine
3,461,575 A 8/1969 Tead et al.
4,438,573 A * 3/1984 McBarron ..... 36/3 B
4,939,851 A 7/1990 Miller
5,400,526 A * 3/1995 Sessa ..... 36/3 B
6,003,246 A 12/1999 Pan
6,014,821 A 1/2000 Yaw
6,029,372 A * 2/2000 Pan ..... 36/11.5
D452,770 S 1/2002 Birkenstock
6,499,808 B2 12/2002 Palmberg, Jr.
6,701,640 B2 * 3/2004 Nakano ..... 36/8.1
D514,779 S 2/2006 Birkenstock
7,055,265 B1 6/2006 Bathum et al.
D543,685 S 6/2007 Andersen et al.
D563,649 S 3/2008 Andersen et al.
D575,485 S 8/2008 Liow
D600,431 S 9/2009 Little
D628,779 S 12/2010 Martinez et al.
2001/0025432 A1 * 10/2001 Contreras et al. ..... 36/3 R
2001/0048240 A1 12/2001 Palmberg, Jr.
2006/0236561 A1 10/2006 Lee
2008/0022562 A1 1/2008 Manis
2008/0110063 A1 * 5/2008 Liu ..... 36/3 B

* cited by examiner

*Primary Examiner* — Ted Kavanaugh
(74) *Attorney, Agent, or Firm* — Biotech Beach Law Group, PC

(57) ABSTRACT

Footwear is provided including an upper, a porous insole, a midsole, and a solid outsole. The insole has pores that permit sand to fall through the insole. The midsole includes a top surface with a plurality of grooves extending lengthwise between openings on the rear surface of the midsole and openings on the front surface of the midsole.

2 Claims, 13 Drawing Sheets

BEACH SANDAL

FIELD OF THE INVENTION

The present invention relates generally to footwear, and more specifically to footwear having a porous insole and a grooved midsole leading to openings at the front and back of the footwear which permits sand to drain from the insole and out the openings during ordinary walking.

BACKGROUND OF THE INVENTION

On beaches or in other sandy areas, sand often enters and gets trapped inside a user's footwear, causing discomfort, potentially blisters, and making walking more difficult.

Footwear designed for beach use is provided in the patent literature. In particular, U.S. Pat. No. 6,014,821 to Yaw sets forth a seashore sandal including an insole made of plastic wires and an outsole which has grooves and two drain holes on the bottom surface of the sandal. Sand accumulated on the top side of the insole may be washed downward away through the bottom drain holes when water is applied to the top side of the insole. While grooves communicate with the two bottom drain holes, the sand must be precisely delivered for removal. To accomplish this, water is applied to flush the sand along the required passages. Thus, without flushing, sand accumulates in the grooves.

As such, it may be appreciated that there continues to be a need for new and improved footwear that permits sand trapped inside the footwear to easily exit the footwear when a user walks.

SUMMARY OF THE INVENTION

The present invention addresses the deficiencies inherent in the prior art by providing footwear including an upper, a porous insole, a midsole, and a solid outsole. The insole has pores that permit sand to fall through the insole. The midsole includes a top surface with a plurality of grooves extending lengthwise between openings on the rear surface of the midsole and openings on the front surface of the midsole. In some embodiments, the footwear is a sandal.

BRIEF DESCRIPTION OF THE DRAWINGS

Those of skill in the art will understand that the drawings, described below, are for illustrative purposes only. The drawings are not intended to limit the scope of the present teachings in any way.

DETAILED DESCRIPTION OF THE INVENTION

Although the terms used herein are known by those skilled in the art to which the present invention belongs, the following definitions may prove useful to the less skilled artisan.

The term "upper" as used herein refers to the portion of footwear above the sole adapted to secure the footwear to a user's foot. An upper may include a quarter, vamp, counter, and lining.

The term "insole" as used herein refers to the top layer of a sole in direct contact with a user's foot.

The term "midsole" as used herein refers to the layer of a sole between an insole and an outsole.

The term "outsole" as used herein refers to the bottom later of a sole in direct contact with the ground.

The term "lengthwise" as used herein refers to the property of extending entirely from the rear or heel portion of footwear to the front or toe portion.

The term "solid" as used herein refers to the property of being not hollow, or being free from cavities or openings.

In contrast to previous footwear, the advances of the present invention permit sand trapped inside the footwear to easily exit the footwear when a user walks. The improved footwear is particularly useful for walking on beaches or other sandy areas, where sand often enters and gets trapped inside a user's footwear.

Figure 1:
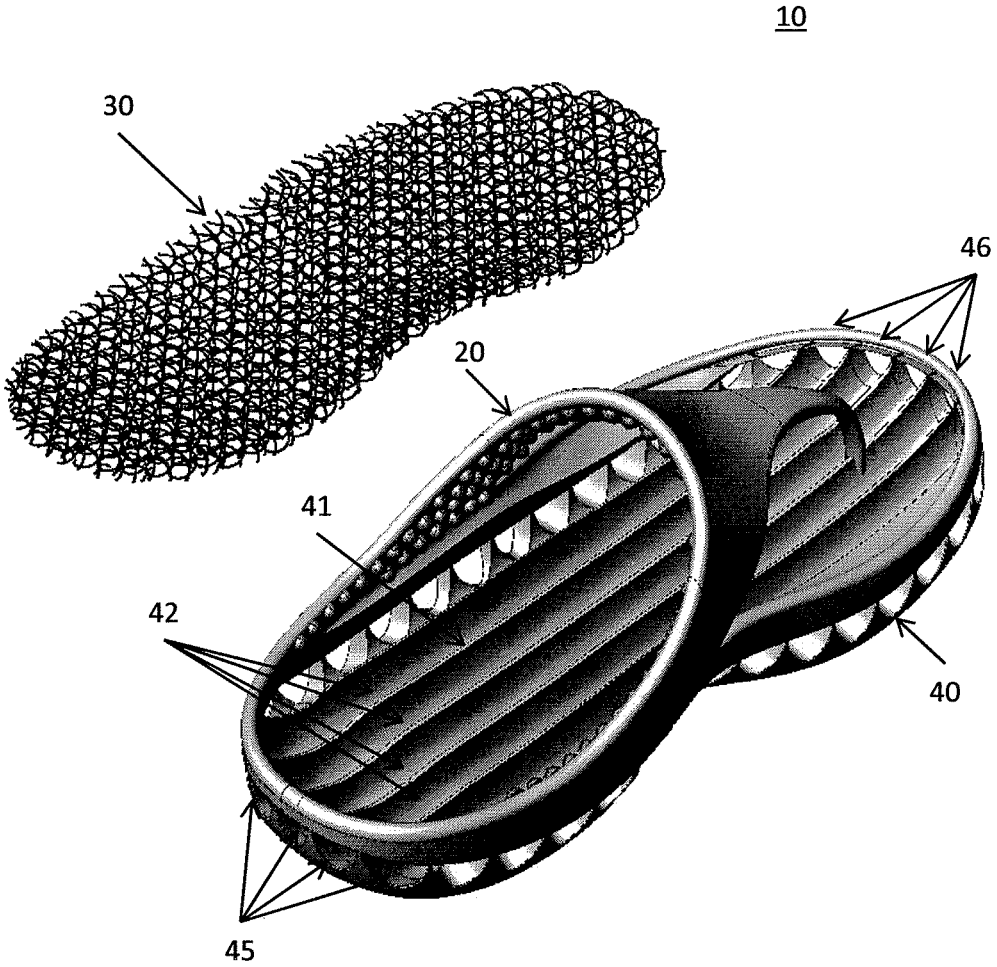
FIG. 1 is a left perspective view of the present invention depicted as footwear 10 showing insole 30 removed for clarity.
Figure 2:
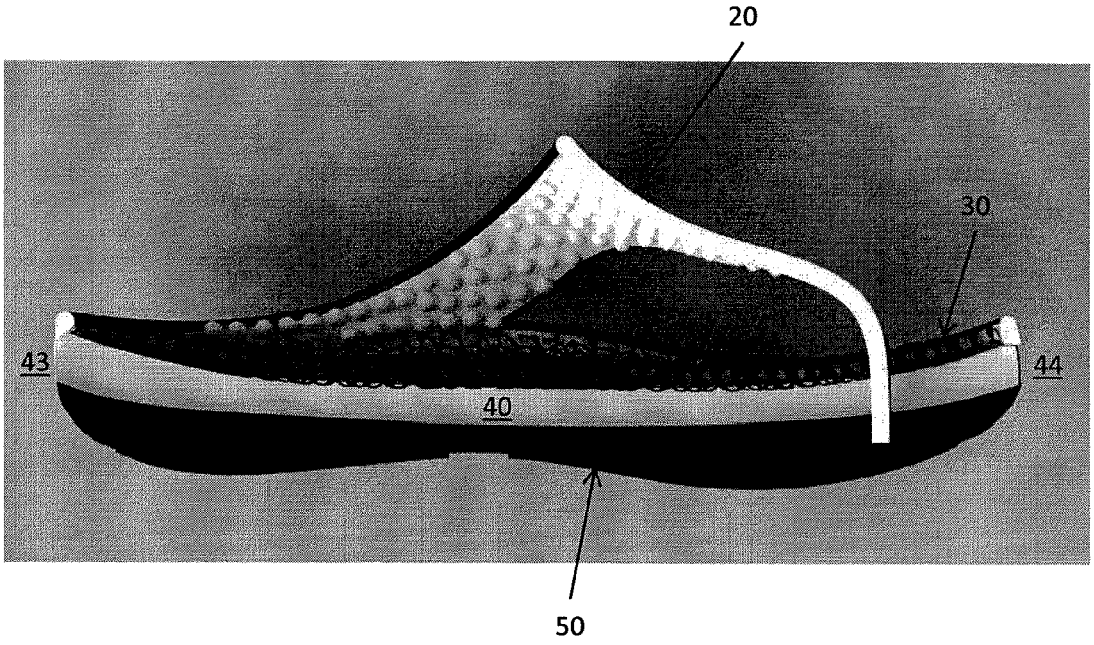
FIG. 2 is a left elevational cross-sectioned view of footwear 10.
Figure 3:
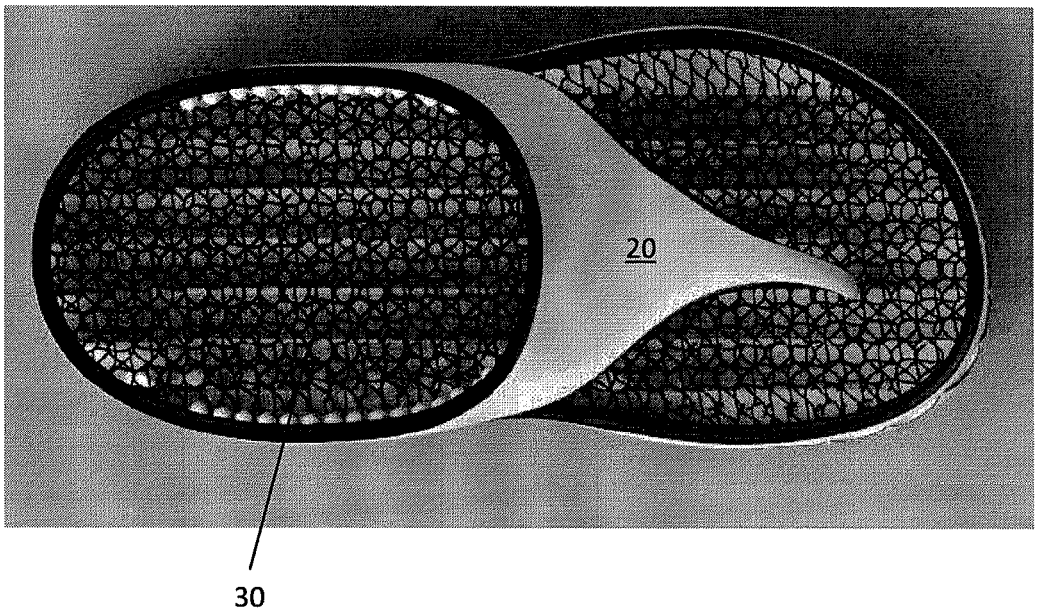
FIG. 3 is a top plan view thereof.
Figure 4:
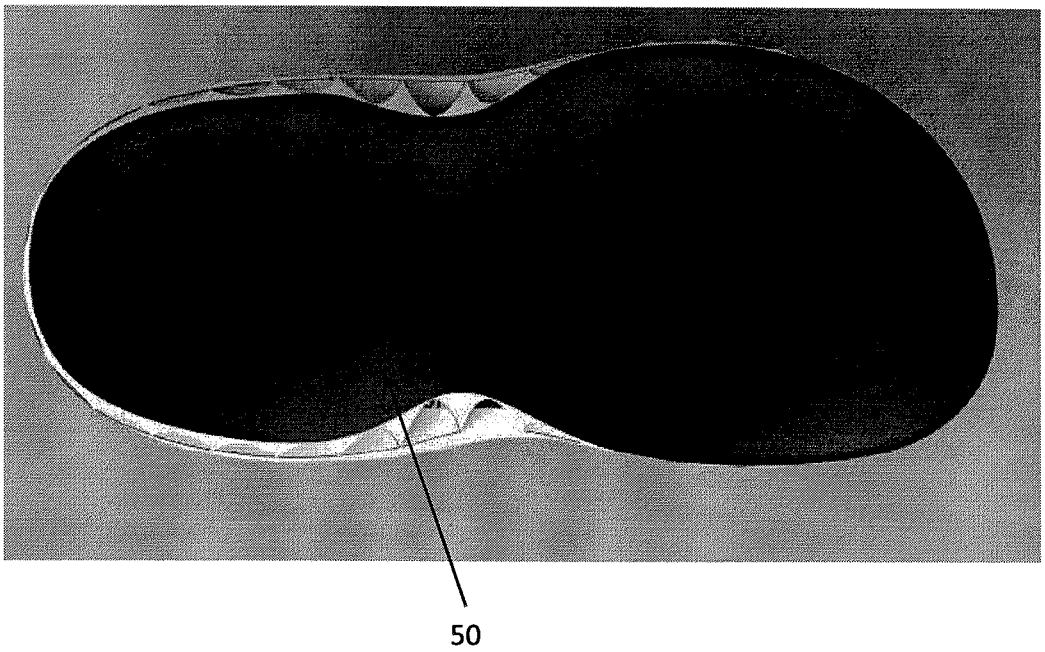
FIG. 4 is a bottom plan view of thereof.
Figure 5:
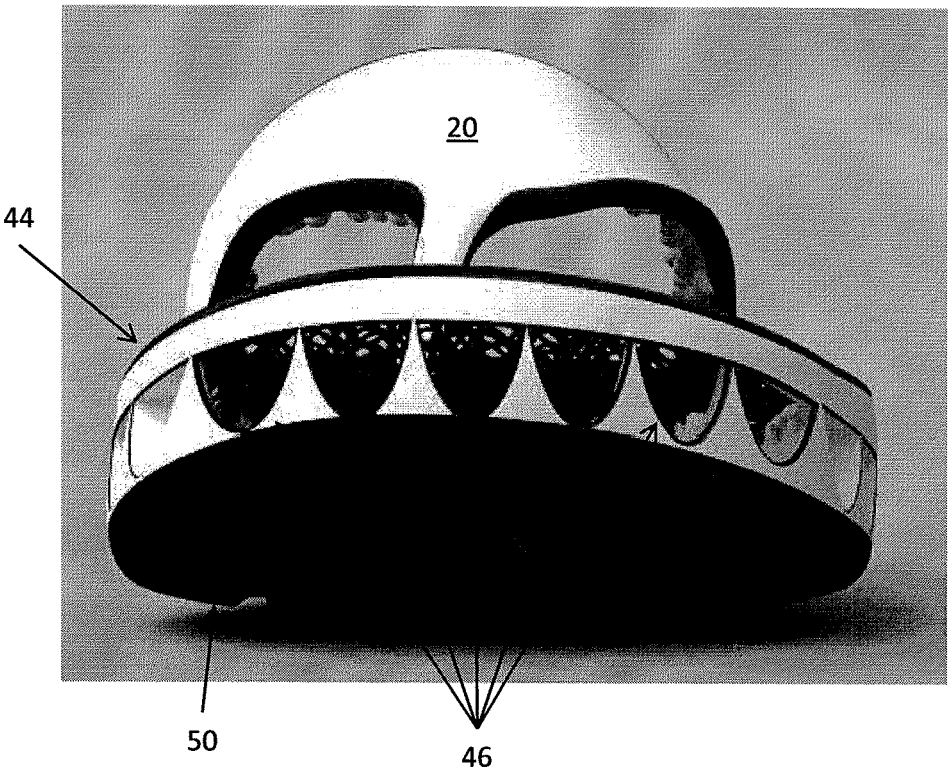
FIG. 5 is a front elevational view thereof.
Figure 6:
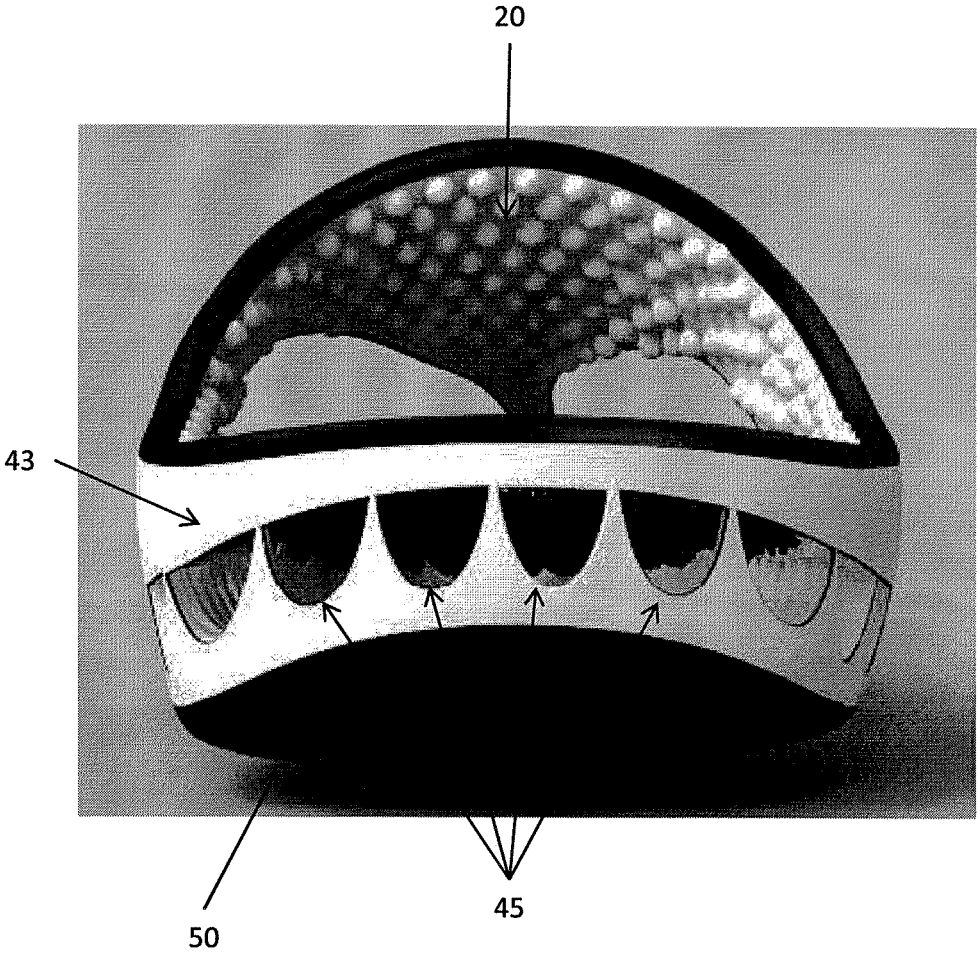
FIG. 6 is a rear elevational view thereof.
Figure 7:
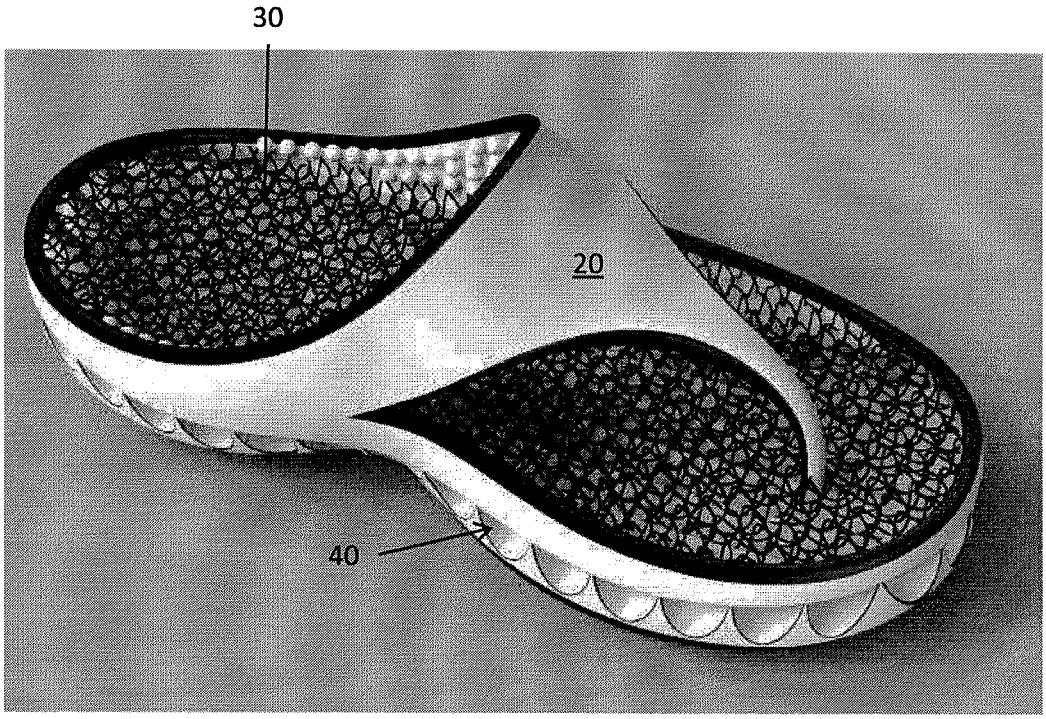
FIG. 7 is a left perspective view thereof.
Figure 8:
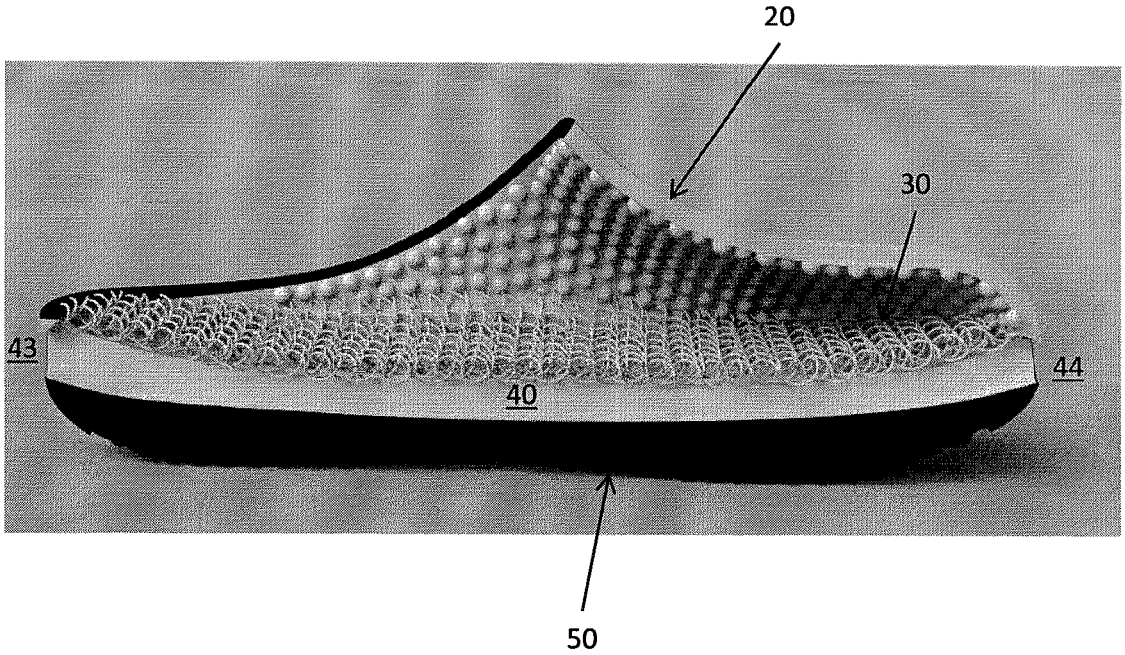
FIG. 8 is a left elevational cross-sectioned view of another embodiment of footwear 10.
Figure 9:
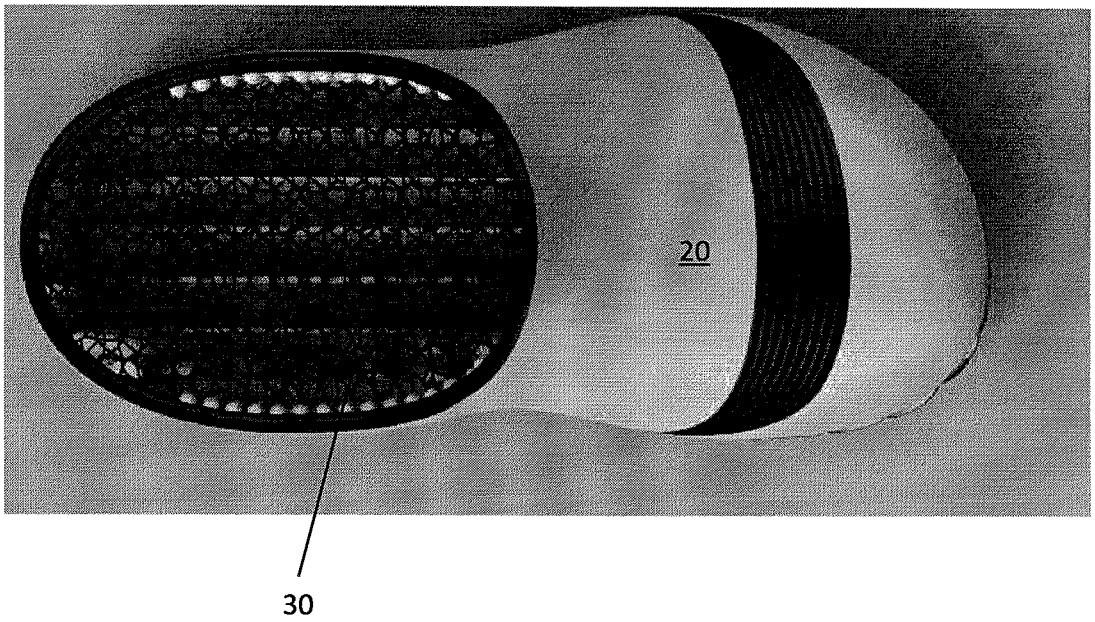
FIG. 9 is a top plan view thereof.
Figure 10:
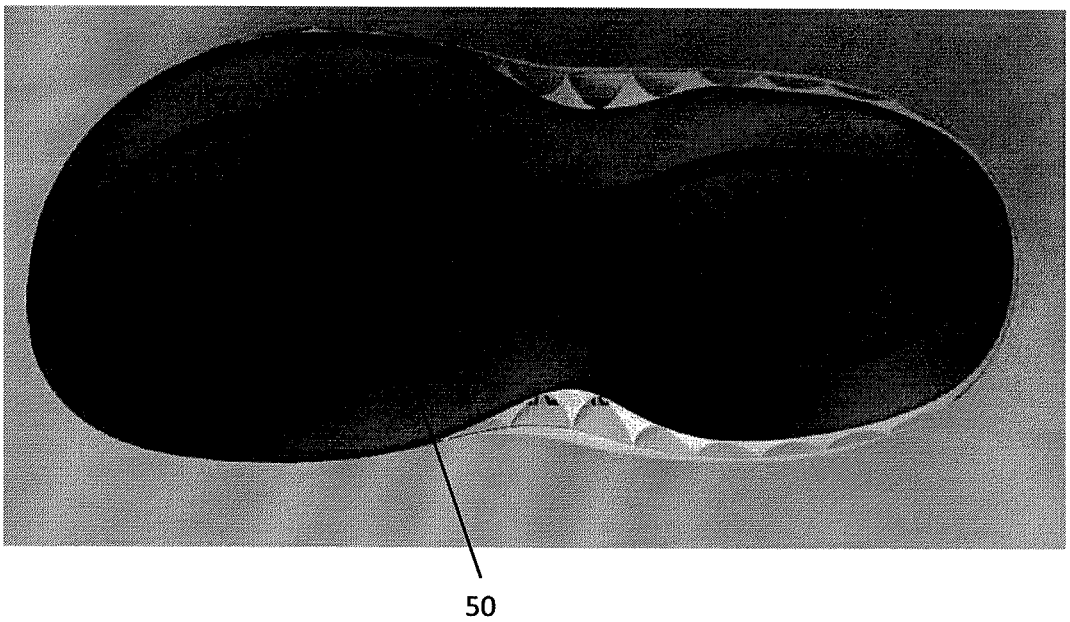
FIG. 10 is a bottom plan view of thereof.
Figure 11:
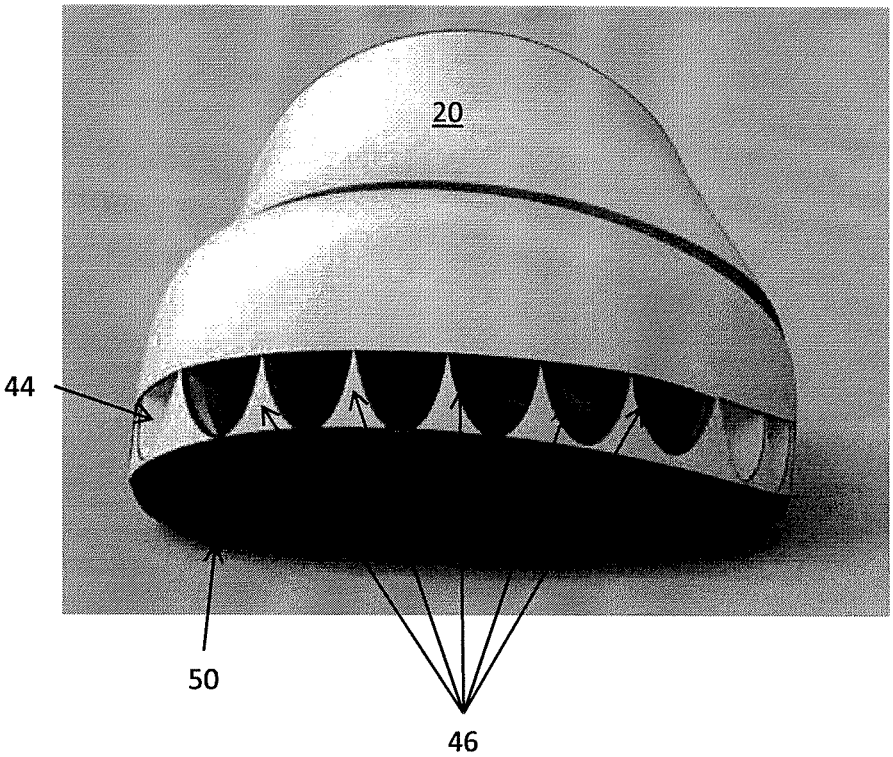
FIG. 11 is a front elevational view thereof.
Figure 12:
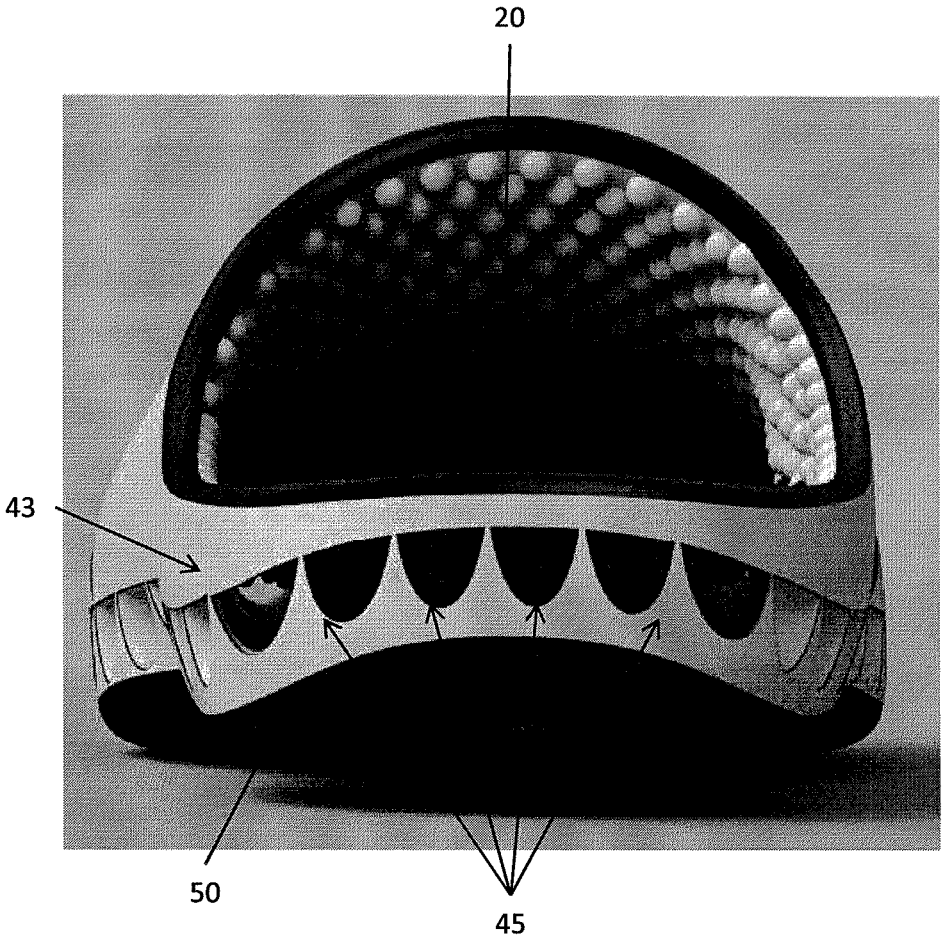
FIG. 12 is a rear elevational view thereof.
Figure 13:
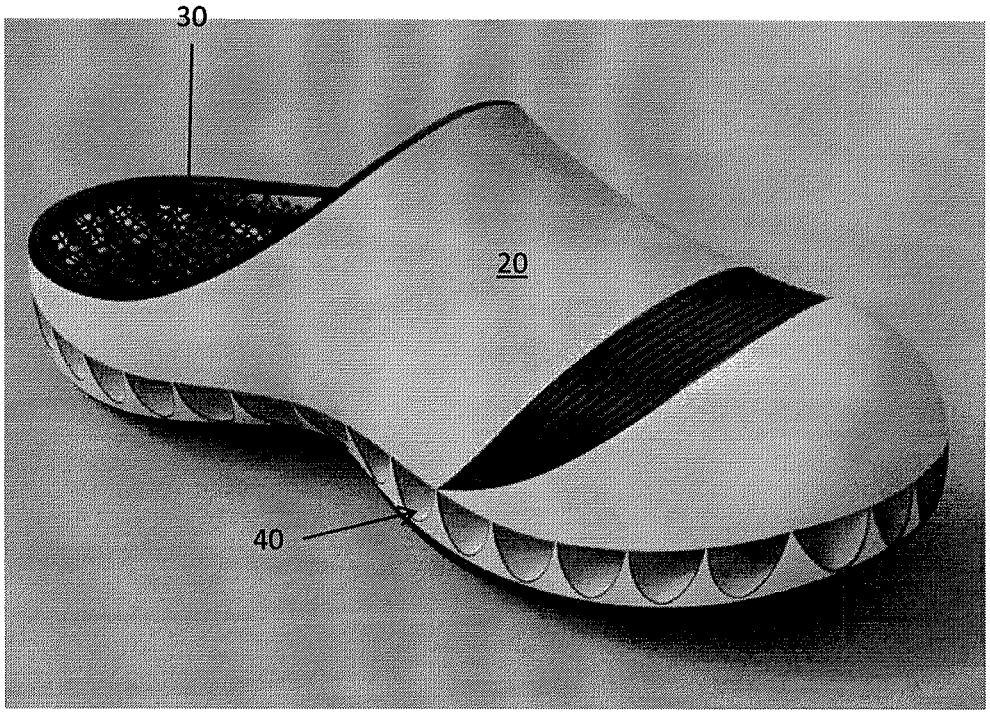
FIG. 13 is a left perspective view thereof.

Referring generally to FIGS. 1-13, the present invention depicted as footwear 10 includes an upper 20, a porous insole 30, a midsole 40, and a solid outsole 50. Insole 30 has pores that permit sand to fall through insole 30. Midsole 40 includes a top surface 41 with a plurality of grooves 42 extending lengthwise between rear openings 45 on midsole rear surface 43 and front openings 46 on midsole front surface 44. Grooves 42 are directly below insole 30. Accordingly, sand on midsole top surface 41 falls through the pores in insole 30 into open grooves 42 due to gravity. Subsequently, when a user walks or otherwise moves footwear 10, the sand is channeled through grooves 42 and exits footwear 10 through rear openings 45 or front openings 46 due to the forces of acceleration caused by such movement. Thus, sand removal does not require flushing the footwear 10 with water. Since outsole 50 is solid, sand cannot exit through the bottom surface of footwear 10.

Porous insole 30 permits sand to flow therethrough. By porous it is meant that a plurality of pores are spread throughout insole 30 to permit sand to fall through the heel, middle, and toe portions of insole 30. The pores should permit sand crystals to easily drain therethrough. Each pore is preferably greater than 1 mm in diameter and traverses the entire thickness of the insole 30.

Upper 20 is adapted to secure footwear 10 to a user's foot. In one embodiment of the present invention depicted in FIGS. 1-7, upper 20 is a plurality of straps defining a thong sandal. In another embodiment depicted in FIGS. 8-13, upper 20 is a single strap defining a slipper. In other embodiments, upper 20 may have other designs, defining different types of footwear such as semi-closed and closed shoes and boots.

Having described the invention in detail, it will be apparent that modifications, variations, and equivalent embodiments are possible without departing the scope of the invention defined in the appended claims.

What is claimed is:

1. A sandal comprising:

a. a single or plurality of straps with an open heel portion defining an upper;

a. a porous mesh insole comprising pores greater than 1 mm in diameter that permit sand to fall through the insole;

b. a midsole that spans the entire length of the sandal, comprising a top surface comprising a plurality of grooves extending lengthwise between opposing openings on the rear surface of the midsole and openings on the front surface of the midsole thereby forming a plurality of lengthwise channels open at both rear and forward ends; and c. a solid outsole.

2. The sandal of claim 1, wherein the sandal is a thong sandal.

* * * * *